US006389978B1

(12) United States Patent
Hooper et al.

(10) Patent No.: US 6,389,978 B1
(45) Date of Patent: May 21, 2002

(54) GUN BARREL CLEANING SHELL

(76) Inventors: Manuel B. Hooper, 80 Pinnacle Dr., Waynesville, NC (US) 28786; Jim C. Counts, 408 Pinnacle Dr., Waynesville, NC (US) 28786

( * ) Notice: Subject to any disclaimer, the term of this patent is extended or adjusted under 35 U.S.C. 154(b) by 0 days.

(21) Appl. No.: 09/711,717

(22) Filed: Nov. 13, 2000

Related U.S. Application Data

(60) Provisional application No. 60/165,382, filed on Nov. 12, 1999.

(51) Int. Cl.[7] ..... F42B 5/24

(52) U.S. Cl. ..... 102/442; 102/440; 222/5; 42/95; 141/329

(58) Field of Search ..... 102/440, 442, 102/529; 124/57; 222/5, 81, 83, 83.5, 541.2; 141/329; 42/95

(56) References Cited

U.S. PATENT DOCUMENTS 938,836 A * 11/1909 Fessenden ..... 102/442
1,495,008 A 5/1924 Feagin ..... 102/442
3,209,690 A 10/1965 Merattoris, Jr. ..... 102/442
3,476,047 A * 11/1969 Davis ..... 102/442
3,740,883 A 6/1973 Kyle ..... 42/1
4,328,632 A 5/1982 Beers ..... 42/1
4,843,750 A 7/1989 Blase ..... 42/95
4,998,368 A 3/1991 Blase ..... 42/95
5,341,744 A 8/1994 Sli ..... 102/442
5,421,263 A 6/1995 Ruohonen ..... 102/435
5,777,258 A 7/1998 Soon ..... 102/442
6,305,576 B1 * 10/2001 Leoncavallo ..... 222/83.5

* cited by examiner

*Primary Examiner*—Harold J. Tudor
(74) *Attorney, Agent, or Firm*—James R. Head

(57) ABSTRACT

A gun barrel cleaning shell uses a pressurized cartridge alone or within a shell casing to propel cleaning material through the bore of the firearm. Inside the cartridge is a strike pin that when the firing pin of the firearm is actuated will cause the strike pin to puncture a rupturable end of the cartridge to release the compressed fluids therein to force the cleaning material toward and through the barrel of the firearm.

10 Claims, 4 Drawing Sheets

GUN BARREL CLEANING SHELL

CROSS REFERENCE TO RELATED APPLICATION

This application claims the benefit of U.S. Provisional Application Ser. No. 60/165,382, filed Nov. 12, 1999, entitled "Gun Barrel Cleaning Shell"

SUBJECT MATTER OF THE INVENTION

This invention relates to the field of apparatus for cleaning firearms, such as shotguns, rifles, and the like.

BACKGROUND OF THE INVENTION

After use, the bore or barrel of a firearm typically contains burnt powder, residue and foreign materials. Such residue and materials have been known to attract moisture during or after use which can collect and corrode the barrel, if not cleaned within a reasonable time after use. Removal of these contaminants and the lubrication thereof is required to prevent corrosion and ultimate damage to the bore, and to maintain the firearm for it's intended use.

Historically, cleaning of the firearm has been done manually using a long multi-part cleaning rod having a handle at one end and means at the other end to hold cleaning materials such as removable solvent, and/or lubricating cleaning pads, patches, and wire brushes. Not only is this time consuming process with the cleaning equipment located elsewhere, usually at home or a shop, but many users put off, or forget the job, sometimes too late to prevent damage to expensive firearms.

Others have proposed propelling special projectiles through the bore of firearms. Many of these have proposed the use of a primer as the explosive force, which in and of itself will leave unwanted residue. Still others have proposed the use of common $CO_2$ cartridges which are punctured by a variety of complex devices to accomplish the propelling force. Such prior art has been disclosed in U.S. Pat. Nos. 1,495,008; 3,209,690; 3,740,883; 4,328,632; 4,843,750; 4,998,368; 5,341,744; 5,421,263; and 5,777,258.

OBJECTS OF THE INVENTION

It is an object of this invention to provide a quick and efficient means of removing contaminants and protecting the bore or barrel of a firearm.

A primary object is to provide an improved power cartridge having an actuating or firing mechanism that simplifies the cleaning and maintenance of firearms.

Another object is to provide a device that will clean and protect the firearm barrel surface which device is small in size, safe to use, and easily carried, unobtrusively, by the user with other firearm accessories. The device can be carried with the hunter or target shooter and used in the field at any time.

Another object is to provide a device for cleaning and protecting the bore of a firearm that is comprised of a single, non-ignitable explosive shell-like casing that can be loaded into the shell chamber and discharged by the action of the firing pin to propel all of the necessary implements for cleaning and applying protective materials,to the bore of a firearm such as a shotgun or rifle.

Another object is to provide a firearm cleaning device that can be used and rearmed and reused for a variety of different types of firearms, such as shotguns, rifles, pistols and revolvers.

A yet further object of the invention is to provide a new form of puncturable pressurized gas, e.g., $CO_2$, cartridge.

Another object of the invention is to provide a puncturable gas cartridge that is particularly designed for use with a firearm cleaning shell that can be positioned within the firing chamber, and fired by the firing pin.

Additional advantages of the present invention will become apparent from the following description and drawings.

SUMMARY OF THE INVENTION

The invention is a gun barrel cleaning device for a firearm having a shell chamber and a firing pin, as shown in the aforementioned prior art. The device comprises a cylindrical casing for seating within the shell chamber with the rearward end of the casing contiguous to the firing pin. Within the casing is a compressed gas cartridge sealed within the casing with its rearward end adjacent the inside rearward end of the casing.

The improved cartridge, at its forward end, is constructed of a rupturable wall portion. Within the cartridge, there is an axially moveable strike pin. The forward end of the pin abuts or is abuttable against the rupturable portion of the cartridge. The rearward end of the strike pin is axially supported so as to abut the rearward end of the casing so as to be moved by the action of the firing pin causing the forward end of the strike pin to rupture the forward end of the cartridge and permit the release of compressed fluid.

A projectile of barrel cleaning material is positioned withing the casing forward of the cartridge so as to be propelled through the firearm barrel upon the release of the compressed fluid.

Although preferably the compressed fluid is a nonflammble, non-corrosive gas, e.g., $CO_2$ or $N_2$, the cartridge could contain a mixture of a propellant gas and liquid. The liquid being a material that functions to also clean, treat, and lubricate the barrel.

The projectile cleaning material can be a wad of material that wipes the inner surface of the barrel to loosen, clean and wipe any residual dirt, burnt powder residue, moisture, or other debris which is carried through the bore and out the open end of the barrel. Materials include random woven organic or synthetic fibers which are larger, usually compressed yet having resiliency and strength to sweep through the diameter of the bore in which it is to be used. Nylon, polyesters, fiberglass, graphite, and those materials described in U.S. Pat. No. 3,740,883 and other prior art are inclusive of this invention.

DRAWINGS

DETAILED DESCRIPTION OF THE INVENTION

Figure 1:
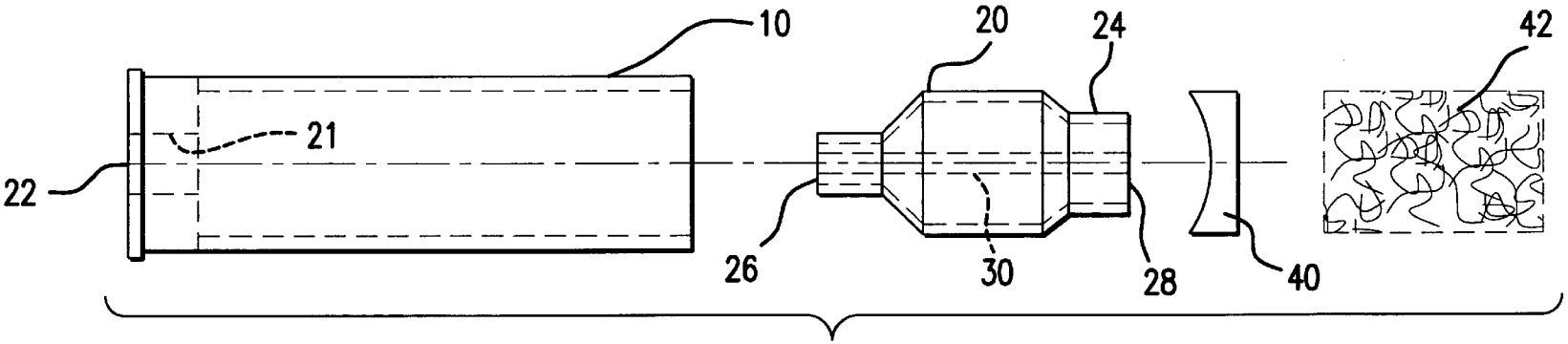
FIG. 1 is an exploded view of one form of firearm bore cleaning device of this invention.
Figure 3B:
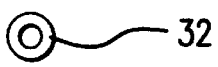
FIG. 3B is a front view of the guide of FIG. 3A.
Figure 4B:
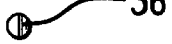
FIG. 4B is an end view of the cartridge strike and rupturing pin.
Figure 3A:
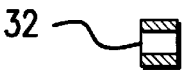
FIG. 3A is a sectional view of the cartridge strike pin guide.
Figure 4A:
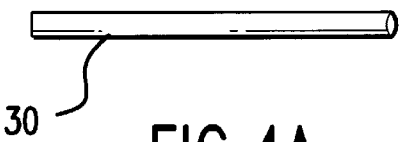
FIG. 4A is a side view of the cartridge strike and rupturing pin.
Figure 2:
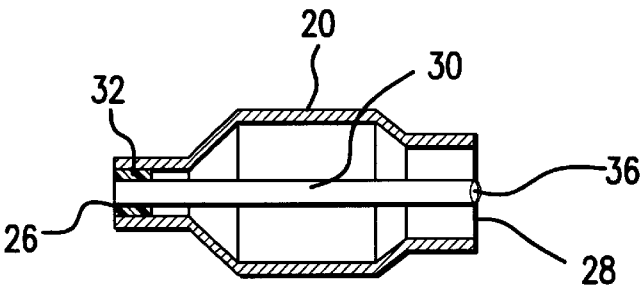
FIG. 2 is a sectional view of a compressed air or $CO_2$ cartridge powered cylinder for use with this invention.

Reference is made to FIGS. 1–5 where like numerals refer to like parts in all the views. In this embodiment, the cylindrical outer shell casing 10 is a regular shotgun shell or casing as commercially found for loading conventional shells. Of course, the casing and its assembly per this invention may be specially manufactured for use with this invention. Positioned within the casing 10 is a metal power cylinder 20 containing compressed fluids, including $CO_2$, or compressed gas, and/or liquids in combination therewith. The cartridge 20 comprises a rearward end cap 26 and a forward nozzle portion 24. The rearward end 26 is sealed and is of diameter so as to fit within the opening 21 of the end cap 22. In some instances this is the place within the casing where a normal shotgun shell primer is located. The forward end of the cartridge 20 is sealed by a rupturable closure 28. This closure may be of a thinner wall of the metal cartridge 20. Contained within the cartridge 20 is a axially movable strike pin 30 that extends across the length of the cartridge. The strike pin 30 is axially supported by a guide bushing 32, which may be of metal or resilient material (See FIG. 5), that abuts against the sealed firing end cap 22. The forward end of the strike pin 36, which may be pointed or sharpened, is abutting, or abuttable, against the rupturable closure 28.

Forward of the cartridge 20 is a combination of a compressed wad material 40, that acts like a piston when propelled forward in use. Forward of the wad material 40 is a mat of fibrous cleaning material 42. This combination is not to be limiting to the invention, as a variety of propelled cleaning materials and objects as known in the prior art are within the scope of this invention.

Figure 5:
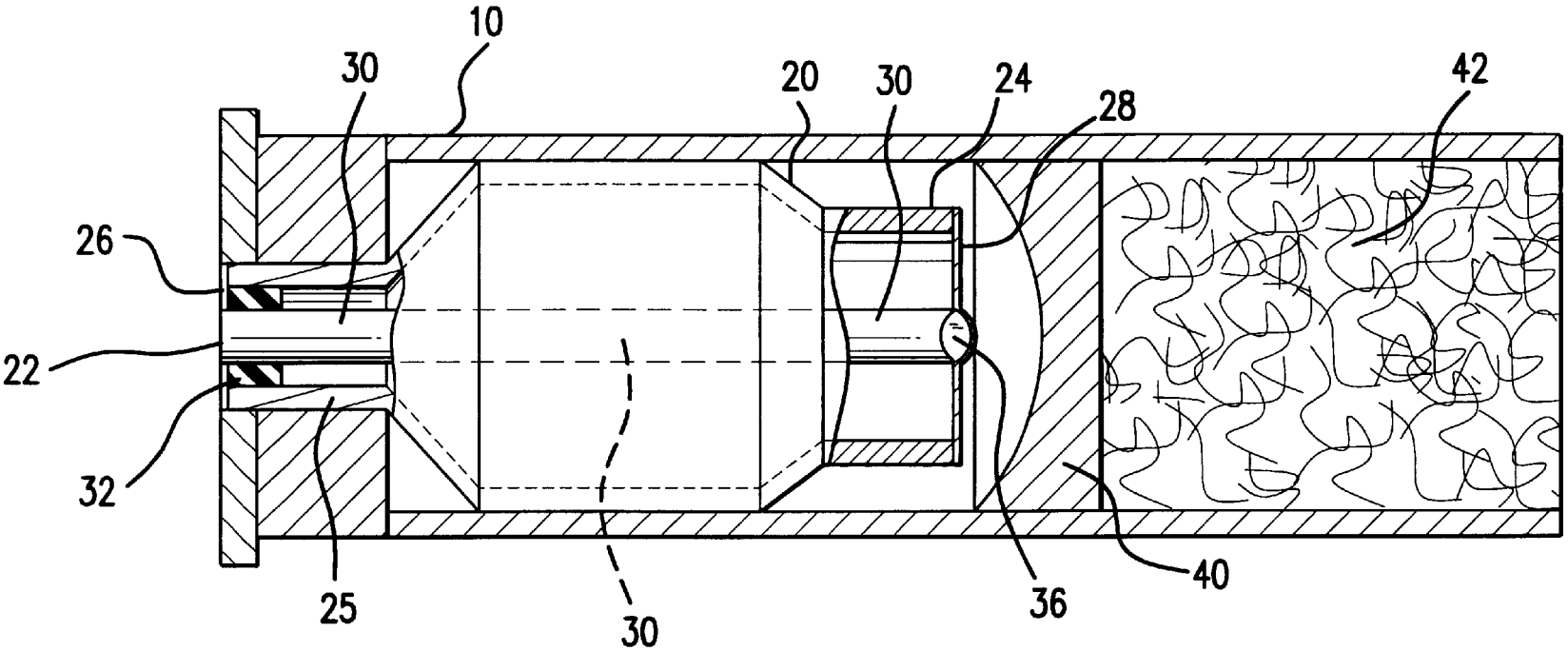
FIG. 5A is a sectional view of one form of firearm bore cleaning device of this invention as assembled.
Figure 6:
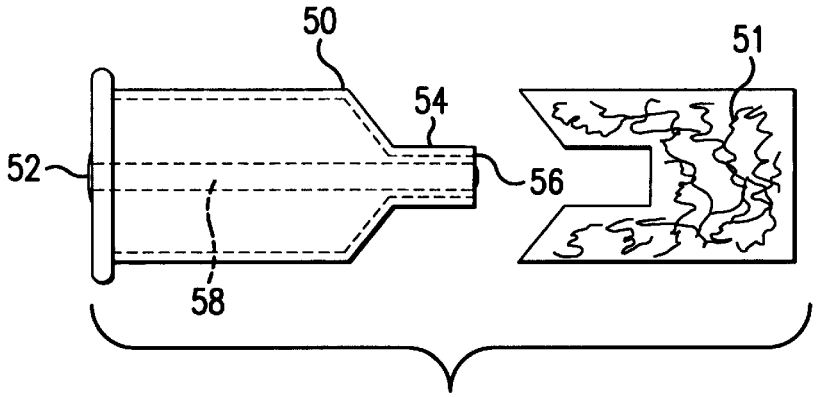
FIG. 6 is an exploded view of an alternate embodiment of a power cylinder and cleaning material.

FIG. 6 represents an alternate embodiment wherein a power cartridge 50 is combined with a piston of cleaning material piston 51, which assembly, essentially becomes the 'shell', without the usual casing 10, as shown in FIGS. 1 and 5, to be positioned within the firearm's firing chamber. This embodiment can also be used within a casing 10. The rearward end 52 of the 'shell' is placed adjacent the firearm's firing pin, not shown, but well known in the art. A forward nozzle end 54 includes a rupturable closure 56. A strike pin 58 is axially supported within the cartridge from the rearward end 52 to the forward end 54 against the rupturable closure 56.

Figure 7:
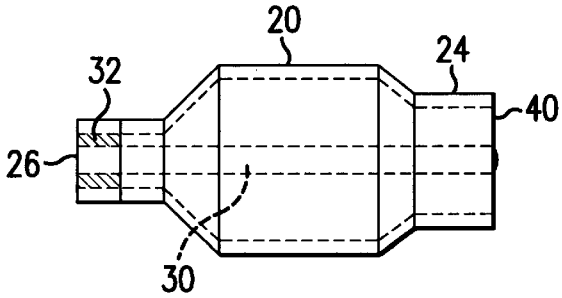
FIGS. 7–9 represent other forms of power cylinders for use in this invention.
Figure 8:
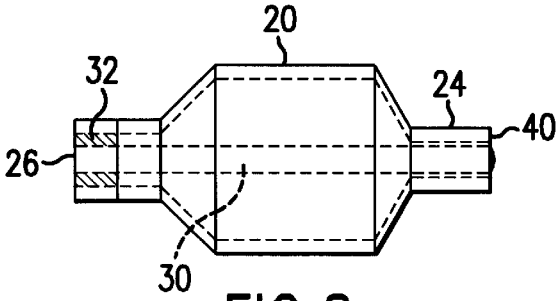

FIGS. 7 and 8 represent a variety of modified power cartridge shapes for use with the invention, but still using the heretofore described elements.

Figure 9:
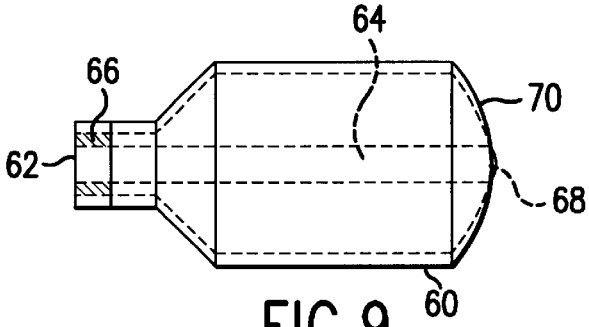

FIG. 9 is yet another form of cartridge having metal cartridge 60, with a rearwardly sealed end 62 and internal strike pin 64. The strike pin 64 is axially supported by guide bushing 66 at the rearward end. The forward end 68 of the strike pin 64 is sharpened so as to rupture the forward end 70 of the cartridge when actuated by movement of the firearm's firing pin.

Figure 10:
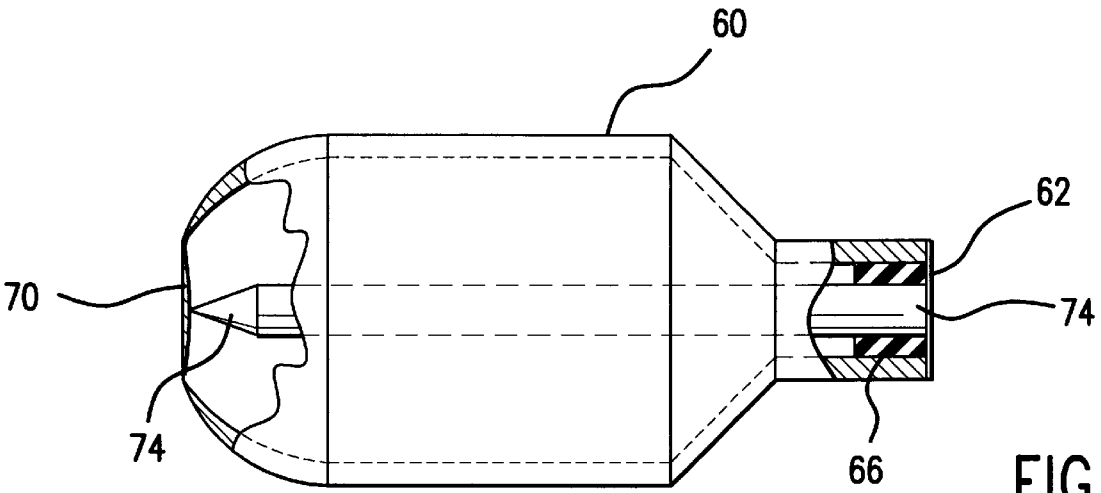
FIG. 10 is an assembly view, in partial cross section, of another embodiment similar to that shown in FIG. 9.
Figure 11:
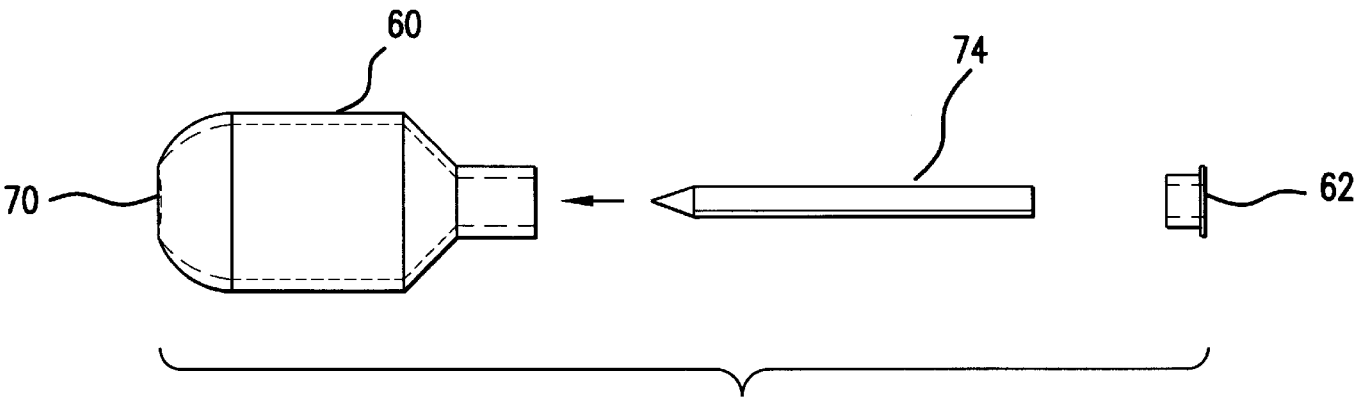
FIG. 11 is an exploded view of the parts that make up the embodiment of FIG. 10.

FIG. 10, and the exploded view of FIG. 11, is similar to the embodiment of FIG. 9 with like numbers used for like parts. In this embodiment the strike pin 74 is pointed so as to effect rupture of the end 70.

The rupturable end 70 is, for example, of a thickness in the center of about 0.011" or less, or at least sufficient to contain compressed fluids of at least 250 psi.

The power cartridges of this invention will sufficient compressed gases, usually $CO_2$, to fire the wad and/or cleaning materials through and out the bore of the firearm where they quickly lose power once the cleaning materials leave the bore. It is apparent to the man skilled in the art that the amount of compressed energy will vary with the size of the gun barrel and the characteristics of the cleaning materials to be propelled through the barrel. For example, with a standard 12 gage shotgun the amount of compressed gases will be within the range of 50 to 1250 psi.

Although, the cleaning materials shown in these views comprise the wad 40 and open or random woven or matted fibrous material 42, this is not to be limiting to the invention. Other forms and combinations of cleaning materials are inclusive of this invention. This includes, but is not limited to pads, patches, metallic scraping devices, lubricants, and rust inhibitors. Those cleaning and lubricating materials described in the prior art patents are incorporated herein by reference.

In use, the assembly described herein is positioned in the shell chamber of the gun. The firing pin of the gun is activated by it's own trigger mechanism to strike the rearward end 22, of the power cartridge 20 (end 52 and cartridge 50 of FIG. 6). See also end 62 of cartridge 60 in FIGS. 9–11. That action causes a slight forward movement of the strike pin 30 sufficient to rupture the forward closure 28 as shown in FIG. 5, or strike pin 58 and forward closure 56 of FIG. 6, or strike pin 64 and forward closure 70 of FIG. 9, or strike pin 74 and forward closure 70 of FIGS. 10 and 11. With rupture of the cartridge, compressed fluids are released forwardly. The propellant strikes the wad 40 (51 of FIG. 6), moving it, and cleaning materials 42 forward out of the shell casing into and through the bore of the gun. As the wad and cleaning materials pass through the barrel, the scraping and cleaning action loosens the residual powder and carries it out the end of the barrel. As with any firearm, safety is paramount. The cleaning action should not be pointed toward any person or object that may be harmful. Preferably, the cleaning material will drop harmlessly once it leaves the gun barrel.

Another aspect of this invention is a new type of compressed gas cartridge for other intended usages. For example, as an emergency inflating device for life preservers, other inflatable devices.

Other modifications and variations of the present invention are possible in light of the above teachings and within the scope of the appended claims without departing from the spirit and intended scope of the invention.

We claim:

1. A gun barrel cleaning device for a firearm having a shell receiving chamber and a firing pin, comprising:

a cylindrical shell casing for seating within said shell receiving chamber, the rearward end of said cylindrical shell casing positionable contiguous to said firing pin;

an independently removable and replaceable cylindrical cartridge containing compressed fluid, said cartridge being of a first diameter so as to be in contact with an inner surface of said cylindrical shell casing, a rearward end of said cartridge, of a smaller diameter than said first diameter, positioned adjacent said rearward end of said cylindrical shell casing, a forward end of said cartridge having a rupturable wall portion;

an axially movable strike pin sealed within said cartridge, a forward end of said pin being abuttable against said rupturable wall portion of said cartridge, a rearward end of said pin held within said smaller diameter of said cartridge and abutting said rearward end of said cylindrical shell casing so as to be moved forwardly by the action of said firing pin;

a projectile of barrel cleaning material forward of said cartridge so as to be propelled through said barrel when said firing pin moves said strike pin forwardly to rupture said rupturable wall portion.

2. The gun barrel cleaning device of claim 1, wherein said compressed fluid is a gas.

3. The device of claim 2 wherein said gas is $CO_2$.

4. The device of claim 1 wherein said compressed fluid is a combination of gas and liquid.

5. The device of claim 4 wherein said gas is $CO_2$.

6. The device of claim 1 wherein said cleaning material includes random matted fibers.

7. The device of claim 6 wherein said fibers are compressed.

8. The device of claim 6 wherein said fibers are organic, synthetic or non-organic.

9. The device of claim 6 wherein said cleaning material includes a wad of cleaning material positioned between said forward end of said cartridge and said fibers.

10. A gun barrel cleaning device for a firearm having a shell receiving chamber and a firing pin, comprising:

a cylindrical shell for seating within said shell receiving chamber, the rearward end of said cylindrical shell positionable contiguous to said firing pin;

an independently removable and replaceable cylindrical cartridge containing compressed $CO_2$, said cartridge being sealed within said cylindrical shell, a rearward end of said cartridge adjacent said rearward end of said cylindrical shell, a forward end of said cartridge having a rupturable wall portion;

an axially movable strike pin sealed within said cartridge, a forward end of said pin being abuttable against said rupturable wall portion of said cartridge, a rearward end of said pin attached to said rearward end of said cartridge and positioned abutting said rearward end of said cylindrical shell so as to be moved forwardly by the action of said firing pin;

a projectile of barrel cleaning material forward of said cartridge, said cleaning material comprises at least a random matted fibrous material so as to be propelled through said barrel when said firing pin causes said strike pin to rupture said rupturable wall portion.

* * * * *